United States Patent [19]

Marsh

[11] 4,086,900

[45] May 2, 1978

[54] VARIABLE POSITION THROTTLE STOP AND DASHPOT APPARATUS

[75] Inventor: Keith D. Marsh, St. Clair Shores, Mich.

[73] Assignee: Colt Industries Operating Corporation, New York, N.Y.

[21] Appl. No.: 706,812

[22] Filed: Jul. 19, 1976

[51] Int. Cl.[2] ..... F02B 77/00

[52] U.S. Cl. ..... 123/198 D; 123/DIG. 11; 123/97 R

[58] Field of Search ..... 123/DIG. 11, 198 D, 123/198 DC, 97 R, 198 DB, 179 B, 179 BG, 179 G, 97 B, 103 R, 103 E

[56] References Cited

U.S. PATENT DOCUMENTS

| | | | |
|---|---|---|---|
| 3,730,153 | 5/1973 | Harrison et al. | 123/DIG. 11 X |
| 3,736,915 | 6/1973 | Dickensheets et al. | 123/DIG. 11 X |
| 3,741,332 | 6/1973 | Sakakibara et al. | 123/198 D X |
| 3,760,785 | 9/1973 | Harrison et al. | 123/DIG. 11 X |
| 3,805,760 | 4/1974 | Yagi et al. | 123/198 DB |
| 3,847,131 | 11/1974 | Hisatomi | 123/97 R X |
| 3,971,356 | 7/1976 | Schlage | 123/DIG. 11 X |

*Primary Examiner*—Charles J. Myhre
*Assistant Examiner*—Ira S. Lazarus
*Attorney, Agent, or Firm*—Walter Potoroka, Sr.

[57] ABSTRACT

A variable position throttle stop and dashpot apparatus is shown as having a variably positionable throttle stop member having positions corresponding to and/or determining positions of engine idle throttle position and engine shut-down or anti-diesel throttle position with dashpot means effective for damping the rate of throttle closing movement regardless of whether the engine is operating or shut-down; resilient means are effective for moving the throttle stop member to a position for early engagement with linkage means associated with the throttle in order to thereby effectively damp the rate of closing movement of the throttle valve; and solenoid means is effective when de-energized to permit the throttle stop member to move to the anti-diesel position.

9 Claims, 2 Drawing Figures

VARIABLE POSITION THROTTLE STOP AND DASHPOT APPARATUS

BACKGROUND OF THE INVENTION

Heretofore, it has been accepted prior art practice to provide what was generally referred to as a fast idle cam which was positioned generally in accordance with the position of the choke valve of an associated carburetor. As is well known in the art, such choke valves were and are usually positioned in accordance with engine temperature. The cam, thusly positioned, coacts with a swingable abutment operatively connected to the engine throttle valve as to thereby be effective for holding the throttle valve open a greater degree during cold engine operation while permitting the throttle valve to close to an established curb idle position, once the engine has attained some preselected operating temperature, as by permitting such swingable abutment to engage either a lowest step portion on the cam or engaging a positive non-movable abutment or stop portion formed as on the carburetor body structure. Such closing of the throttle to a curb idle position determined the absolute maximum closing of the throttle under all conditions of engine operation as well as during engine shut-down. Generally, in the past, such prior art arrangements have been found to be adequate. However, because of governmentally imposed standards relating to engine exhaust emissions, it has become necessary to provide different fuel metering characteristics to the fuel metering devices associated with such engines. This, in turn, has among other things, caused the engine to have a tendency to continue to run even after the engine ignition is turned off; such often being referred to as engine "dieseling." It has been discovered that one way of being able to terminate or avoid such "dieseling" is to further close the throttle valve beyond its normal curb idle position. However, as for reasons already described, such is not possible with the prior art arrangements.

Further, it is highly desirable to damp the rate of throttle closing movement near the end of such closing movement in order to avoid a very sudden change in the rate of air and fuel flow which, if permitted to occur, usually results in rough engine operation and, often, even stalling of the engine. The provision of such damping or dashpot means along with the requirement that the throttle valve be permitted to, at a selected time, move even further closed than the normal maximum closure of curb idle has not been attainable with prior art structures.

Accordingly, the invention as herein disclosed and claimed is primarily directed to the solution of the preceding as well as other related and attendant problems.

SUMMARY OF THE INVENTION

According to the invention, a variable position throttle stop and dashpot apparatus comprises resilient means for positioning a variably positionable abutment member in a first position whereat said abutment member is operatively engagable by the throttle valve as such throttle valve is moving toward a curb idle position in order to thereby damp the rate of closing movement of such throttle valve, second abutment means effective to stop said closing movement of said throttle valve and thereby determine said curb idle position, and solenoid means effective to permit said second abutment means to move to a second position permitting said throttle valve to close, even further than said curb idle position, to an anti-diesel throttle position.

Various general and specific objects and advantages of the invention will become apparent when reference is made to the following detailed description considered in conjunction with the accompanying drawings. DR

BRIEF DESCRIPTION OF THE DRAWINGS

In the drawings, wherein for purposes of clarity, certain details and/or elements may be omitted from one or more views.

DETAILED DESCRIPTION OF THE PREFERRED EMBODIMENT

Figure 1:
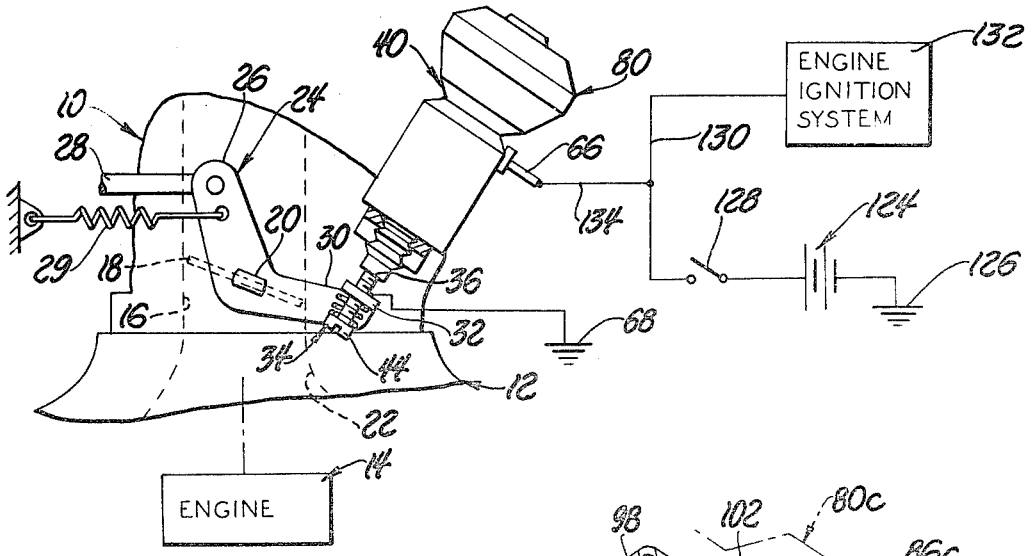
FIG. 1 illustrates apparatus, in fragmentary view, having throttle means the closed positions of which are determined by variable position throttle stop and dashpot apparatus employing teachings of the invention.

Referring now in greater detail to the drawings, FIG. 1 illustrates an induction apparatus, such as, for example, a carburetor 10, carried as atop an intake manifold 12 of an associated engine 14. As generally indicated the inductive apparatus or carburetor 10 has induction passage means 16 formed therethrough with throttle valve means 18 situated therein and carried as by a pivotally rotatable throttle shaft 20. The throttle valve 18 is variably rotatably openable within induction passage 16 as to thereby accordingly control the flow of motive fluid through the induction passage 16 and into the intake passage 22, communicating therewith, of intake manifold 12.

A throttle lever 24, suitably secured to throttle shaft 20 for rotation therewith, has a first arm portion 26 to which suitable throttle actuating linkage means 28 is operatively connected and leading to, for example, the vehicle operator's throttle actuating foot pedal whereby movement of the linkage means 28 to the right causes clockwise opening movement of the throttle valve 18. As is well known, suitable throttle return spring means 29 may be provided to continually yieldingly urge the throttle 18 in a closing direction. An other arm 30 of lever 24 is preferably provided with an integrally formed generally transversely extending flange-like portion 32 which threadably carries a screw member 34 which has its end 36 effective for abuttingly engaging a stop member 38 of the variable position throttle stop and dashpot apparatus 40. A spring 42 may be carried generally about the shank of screw 34 and axially contained as between flange 32 and the head 44 of screw 34 as to thereby aid in frictionally retaining screw 34 in any threadably selected position relative to flange 32.

Figure 2:
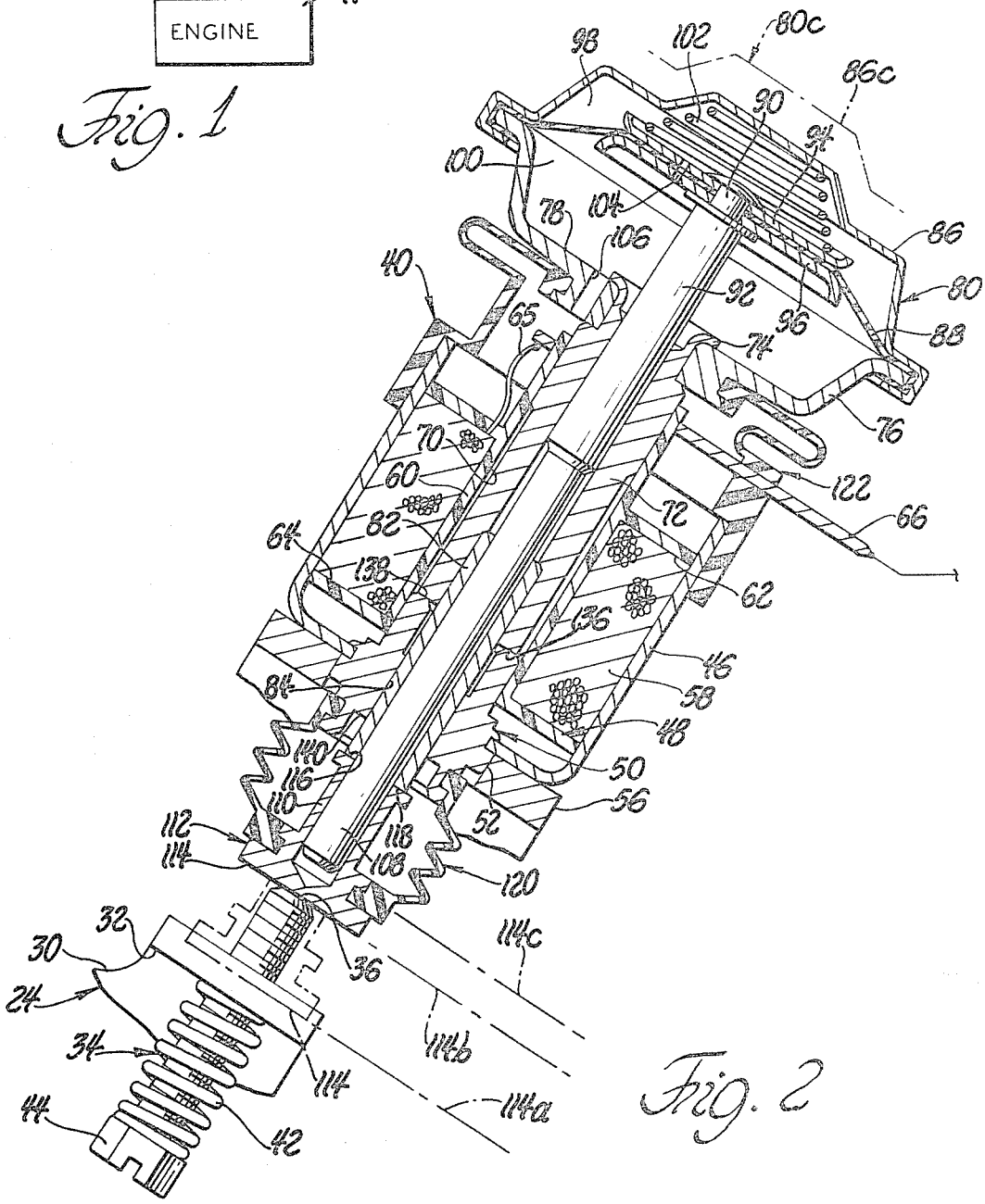
FIG. 2 is an enlarged generally axially extending cross-sectional view of the throttle stop and dashpot apparatus of FIG. 1.

Referring to FIG. 2, the apparatus 40 is illustrated as comprising a generally tubular outer body section or housing 46 which contains, in the lower portion thereof, a bobbin member 48. The bottom end of housing 46 may be secured as to a tubular or bushing-like member 50 which, as illustrated may have its outer portion 52 suitably received within and retained by related mounting bracket means 56.

An electrically energizable field winding or coil 58 is carried generally about the centrally disposed tubular portion 60 of bobbin 48 as to be situated generally between axially opposite radially extending annular flange portions 62 and 64. One electrical end 65 of coil 58 may be electrically connected to a terminal member 66, carried as by tubular portion 60, while the other electrical end, as is generally well known in the art, may be suitably grounded as through housing 46 to support bracket 56 as generally depicted, for example, at 68 of FIG. 1.

A passage 70 formed in tubular portion 60 slidably receives therein an elongated tubular member 72 fixedly secured at its upper end 74 to the lower wall 78 of a housing section 76 of a dashpot assembly 80. A second tubular member 82 has its upper end received by member 72 and fixedly secured thereto as being, for example, press-fitted therein to form a functionally unitary structure with housing section 76 and tubular member 72. While upper tubular member 72 is slidably received within passage 70 of portion 60, lower tubular member 82 is slidably within a passage 84 of bushing member 50.

The dashpot assembly 80 is illustrated as being comprised of lower housing section 76 and upper housing section 86 which cooperate to generally peripherally contain and retain a diaphragm member 88 to which the upper end 90 of a rod 92 is secured as by oppositely disposed diaphragm plates 94 and 96. Diaphragm 88 serves generally as a flexible common wall separating variable chambers 98 and 100. A spring 102 situated generally within chamber 98 serves to continually resiliently urge diaphragm 88 and rod 92 downwardly. As generally depicted at 104, suitable calibrated air bleed restriction passage means are provided as to thereby enable the controlled passage or transfer of air from chamber 98 to chamber 100 as diaphragm 88 is being moved against spring 102 and in the direction of decreasing the volume of chamber 98. The practice of the invention is not limited to the precise air bleed means depicted since any functionally equivalent means may be used many of which are well known in the art. Chamber 100, if desired, may be vented to generally atmospheric pressure as by vent passage means 106 formed through wall 78 of housing section 76.

Rod 92, slidably received within upper and lower tubular members 72 and 82, has its lower end 108 fixedly received within a tubular extension 110 of an abutment member 112 having an outer end abutment surface 114 and an inner end abutment surface 116. As illustrated, the inner abutment surface 116 is adapted to at times cooperatively abut against lower end abutment surface 118 of lower tubular member 82. Preferably, a flexiable boot-like or bellows seal 120 is operatively secured at its opposite ends to bushing member 50 and abutment member 112. Somewhat similarly, a flexible bellows-like seal 122 is operatively secured at its opposite ends respectively to tubular housing section 46 and lower housing section 76 of dashpot assembly 80.

As generally depicted in FIG. 1, a suitable source of electrical potential 124, electrically grounded as at 126, is electrically connected at its otheer terminal as to a vehicular key-operated ignition switch 128 which, when closed, completes an electrical circuit via conductor means 130 to the associated engine ignition system 132. As illustrated, terminal 66 is electrically connected, via conductor means 134, to conductor 132 as to thereby cause energization of solenoid coil means 58 upon closure of switch means 128.

OPERATION OF INVENTION

For purposes of illustration let it be assumed that the ignition switch 128 is closed thereby causing solenoid coil 58 to be energized resulting in tubular member 72, acting as a solenoid armature, being moved downwardly until annular end surface 136 of member 72 abuts against opposed end surface 138 of bushing member 50 thereby assuming the position as shown in FIG. 2. Now if it further assumed that throttle valve 18 is rotated some substantial distance in the opening direction, it can be seen that screw abutment 34 will generally move in a direction away from movable abutment means 112. As a consequence thereof, spring 102 is able to move diaphragm 88, rod 92 and abutment means 112 generally downwardly (or outwardly) until diaphrgam plate 96 abuts against the inner surface of transverse wall section 78. At this time movable abutment member 112 will have assumed a position whereat its abutment surface 114 will be at an extended distance generally depicted by line **114*a*. If at this time throttle 18 is permitted to return toward its curb idle position, lever 24 (FIG. 1) rotates counter-clockwise and in so doing end 36 of screw 34 contacts surface 114 (at position 114*a*) and, because of the force of throttle return spring means 29, continues to move in the counter-clockwise direction against the resilient resistance of spring 102 transmitted through rod 92. Consequently, rod 92 and abutment member 112 move generally inwardly and toward the remainder of assembly 40 with such movement continuing until end surface 116 of abutment 112 engages end surface 118 of tubular member 82. When this occurs, surface 114 of abutment member 112 will assume a position generally in-line with the line depicted at 114*b***.

It should be observed that as abutment 112 is thusly being moved from position **114*a* to position 114*b*, diaphragm 88 is also being moved toward chamber 98. Consequently, the air within chamber 98, which is undergoing a reduction in volume, must pass or flow through calibrated or restricted bleed passage means 104. Therefore, the rate of movement during this distance of travel is somewhat retarded as compared to the rate of movement that the throttle valve 18 would otherwise experience due to return spring means 29. The position designated as 114*b*** would correspond to and designate the normal or curb idle throttle position.

Assuming now that abutment member 112 is in its position **114*b* and throttle valve 18 is in its curb idle position, let it be further assumed that the ignition switch 128 is opened in order to shut-down the engine 14. When this happens, solenoid coil 58 is de-energized thereby releasing armature means 72 and permitting return spring means 29, because of its continuing biasing force, to further move abutment member 112, tubular member 82, armature 72 and housing sections 76 and 86 generally upwardly. Such motion continues until the laterally extending portion of end surface 116 of abutment 112 engages the recessed surface 140 of end bushing member 50. At that time the end abutment surface 114 of abutment member 112 assumes a position generally depicted by line 114*c* while the dashpot assembly 80 and housing section 86 assume positions as generally depicted at 80*c* and 86*c*. Consequently, end 36 of screw means 34 has moved the distance generally represented between lines 114*b* and 114*c* and as a result thereof throttle shaft 20 and throttle valve 18 have rotated in the counter-clockwise or throttle-closing-direction a related amount beyond that which was previously established as the normal curb-idle throttle position. Accordingly, the permissible flow through induction passage means 16 past throttle valve means 18 is even further restricted, if not totally prevented, thereby reducing, or eliminating, the further flow of motive fluid to the engine 14** and preventing the occurrence of engine "dieseling" after the ignition system is de-energized.

Although only a preferred embodiment of the invention has been disclosed and described, it is apparent that other embodiments and modifications of the invention are possible within the scope of the appended claims.

I claim:

1. Apparatus for variably stopping the closing movement of throttle valve means controlling the flow motive fluid to an associated engine, comprising variably positionable abutment means effective for operative engagement with said throttle valve means when said throttle valve means is moved toward a closed position, first means for moving said abutment means to a first position whereat said throttle valve means when moved toward said closed position operatively engages said abutment means to thereby move said abutment means from said first position to a second position whereat said throttle valve means is opened an amount less than the opening of said throttle valve when said abutment means was operatively engaged by said throttle valve means in said first position, and second means for inhibiting the rate of movement of said abutment means from said first position to said second position, said first means comprising resilient means and solenoid means, said resilient means being effective to urge said abutment means toward said first position, said solenoid means being effective to provide movable stop means in order to thereby establish said second position to which said abutment means may be moved, said solenoid means being effective upon de-energization thereof to effectively remove said movable stop means in order to permit said abutment means to move to a third position whereat said throttle valve means when operatively engaging said abutment means is open an amount less than the opening of said throttle valve means when said abutment means was operatively engaged by said throttle valve means in said second position, said second means and said solenoid means being displaceable with respect to each other.

2. Apparatus according to claim 1 wherein said second position corresponds to normal curb idle throttle position, and wherein said throttle valve means when in said third position is effective to at least greatly restrict any flow of motive fluid past said throttle valve means and thereby at least minimize the possibility of said associated engine "dieseling" after the ignition system of said engine has been turned off.

3. Apparatus according to claim 1 wherein said third position is effectively equivalent to said throttle valve means being fully closed.

4. Apparatus according to claim 1 wherein said second means comprising motion damping means.

5. Apparatus according to claim 4 wherein said damping means comprises chamber means, movable wall means at least partly defining said chamber means, motion transmitting means operatively interconnecting said abutment means and said wall means, said chamber means containing displacable fluid therein, and restriction means communicating with said chamber means and effective for controllably restricting the flow of said displacable fluid from said chamber means as said displacable fluid is being displaced therefrom by movement of said wall means into said chamber means.

6. Apparatus according to claim 5 wherein said solenoid means comprises armature means and coil means, wherein said armature means is operatively connected to said wall means, and wherein said armature means said chamber means and said wall means are movable to and from operating positions corresponding to said second and third positions upon energization and de-energization of said coil means.

7. Apparatus according to claim 6 wherein said coil means is energized whenever the ignition system of said associated engine is turned on, and wherein said coil means is de-energized whenever said ignition system is turned off.

8. Apparatus according to claim 7 wherein upon energization of said coil means said armature means chamber means and wall means are moved to one of said operating positions corresponding to said second position.

9. Apparatus according to claim 8 wherein said solenoid means further comprises a bobbin member carrying said coil means, wherein said armature means is axially centrally slidably received by said bobbin member, wherein said chamber means comprises housing means operatively fixedly secured to said armature means for movement therewith, wherein said motion transmitting means comprises a rod member axially slidably received through said armature means, wherein said abutment means comprises an abutment member, said abutment member being fixedly secured to and carried by one end of said rod member, wherein said wall means comprises a diaphragm member, and wherein an other end of said rod member opposite to said one end is secured to said diaphragm member.

* * * * *